US009329612B2

(12) United States Patent
Alatrash

(10) Patent No.: US 9,329,612 B2
(45) Date of Patent: May 3, 2016

(54) METHODS AND SYSTEMS FOR MITIGATION OF INTERMITTENT GENERATION IMPACT ON ELECTRICAL POWER SYSTEMS

(71) Applicant: Petra Solar, Inc., South Plainfield, NJ (US)

(72) Inventor: Hussam Alatrash, South Plainfield, NJ (US)

(73) Assignee: Petra Solar, Inc., South Plainfield, NJ (US)

( * ) Notice: Subject to any disclaimer, the term of this patent is extended or adjusted under 35 U.S.C. 154(b) by 175 days.

(21) Appl. No.: 14/047,490

(22) Filed: Oct. 7, 2013

(65) Prior Publication Data

US 2014/0097807 A1 Apr. 10, 2014

Related U.S. Application Data

(60) Provisional application No. 61/710,020, filed on Oct. 5, 2012.

(51) Int. Cl.
*G05F 1/70* (2006.01)

(52) U.S. Cl.
CPC ..... *G05F 1/70* (2013.01)

(58) Field of Classification Search
CPC ..... G05F 1/56; G05F 1/70; Y02B 70/126; H02M 1/4208; H02M 7/7575; H02M 3/156; H02M 3/1588
USPC ..... 323/205, 207, 275, 285; 363/78, 79
See application file for complete search history.

(56) References Cited

U.S. PATENT DOCUMENTS

| | | | | |
|---|---|---|---|---|
| 5,659,465 | A * | 8/1997 | Flack et al. | 363/71 |
| 8,352,091 | B2 * | 1/2013 | Haugh | 700/286 |
| 8,362,713 | B2 * | 1/2013 | Recker et al. | 315/293 |
| 2009/0033296 | A1 * | 2/2009 | Hammerstrom | 323/207 |
| 2009/0140715 | A1 * | 6/2009 | Adest et al. | 323/318 |
| 2009/0179626 | A1 * | 7/2009 | Smith et al. | 323/299 |
| 2010/0145532 | A1 * | 6/2010 | Gregory et al. | 700/286 |

* cited by examiner

*Primary Examiner* — Adolf Berhane
(74) *Attorney, Agent, or Firm* — Merchant & Gould P.C.

(57) ABSTRACT

Methods and systems for mitigation of intermittent generation impact on electrical power system may be provided. A voltage of the power line may be monitored. A change in the voltage of the power line may be determined. A power output of an energy generation source connected to the power line may be altered based on the determined change in the voltage on the power line to compensate for the change in the voltage.

13 Claims, 8 Drawing Sheets

METHODS AND SYSTEMS FOR MITIGATION OF INTERMITTENT GENERATION IMPACT ON ELECTRICAL POWER SYSTEMS

REFERENCE TO RELATED APPLICATIONS

Under provisions of 35 U.S.C. §119(e) Applicant claims the benefit of U.S. Provisional Application Ser. No. 61/710,020, filed on Oct. 5, 2012, the disclosure of which is incorporated herein by reference in its entirety.

BACKGROUND

Over the past few years technological innovations, changing economic conditions, changing regulatory environments, shifting of environmental conditions, and social priorities have spurred interest in Distributed Generation (DG) systems. Distributed Generation is a new model for power systems that is based on the integration of small and medium-sized generators into a utility grid. Such generators may be associated with new and renewable energy technologies, such as solar, wind, and fuel cells, into the utility grid. The generators may be interconnected through a fully interactive intelligent electricity network. Most DG resources are primarily used to supplement the traditional electric power systems. For example, DG resources can be combined to supply nearby loads in specific areas with continuous power during disturbances and interruptions of the main utility grid.

BRIEF DESCRIPTION OF THE DRAWINGS

The accompanying drawings, which are incorporated in and constitute a part of this disclosure, illustrate various embodiments of the present disclosure. In the drawings.

DETAILED DESCRIPTION

Overview

Figure 1:
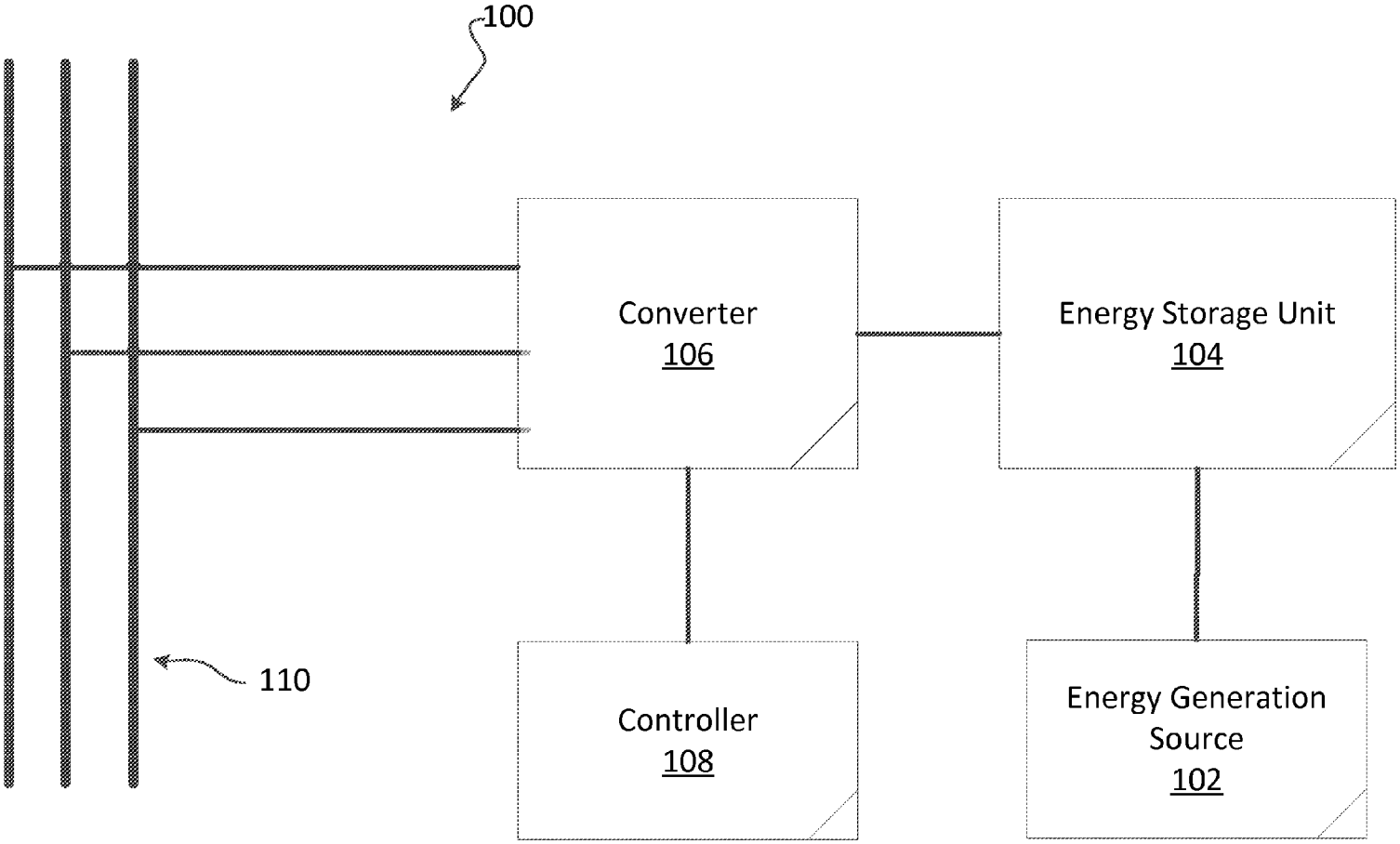
FIG. 1 is an operating environment.

Methods and systems for mitigation of intermittent generation impact on electrical power grid may be provided. A voltage of the power grid may be monitored. A change in the voltage of the power grid may be determined. A power output of an energy generation source connected to the power grid may be altered based on the determined change in the voltage on the power grid to compensate for the change in the voltage.

Both the foregoing overview and the following example embodiment are examples and explanatory only, and should not be considered to restrict the disclosure's scope, as described and claimed. Further, features and/or variations may be provided in addition to those set forth herein. For example, embodiments of the disclosure may be directed to various feature combinations and sub-combinations described in the example embodiment.

Example Embodiments

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims.

Methods and systems for mitigation of intermittent generation impact on an electrical power grid may be provided. For example, intermittent generation from an energy generation source connected to the power grid may lead to voltage fluctuations on the power grid. Embodiments of the disclosure provide methods and systems for detecting the voltage fluctuation on the power grid and controlling an output of the energy generation source to mitigate the voltage fluctuation. For example, a reactive power output of the energy generation source may be controlled to inject reactive power in opposite direction of the voltage fluctuation. The embodiments of the disclosure will be described in more detail in the following sections.

FIG. 1 illustrates a system 100 in which embodiments of the disclosure may be practiced. As shown in FIG. 1, system 100 may include an energy generation source 102, an energy storage unit 104, a power converter 106, a controller 108, and a power grid 110. Although, system 100 is shown to include only one energy generation source, it may be apparent to a person with the ordinary skill in the art that system 100 may include more than one energy generation source connected to power line 110. For example, a plurality of energy generation sources may be connected along power grid 110 in a distributed manner.

Energy generation source 102 may be electrically connected to energy storage unit 104. Energy storage unit 104 may be electrically connected to power converter 106 through a DC link bus. Energy storage unit 104 may be connected to a DC side (also referred to as input side) of power converter 106. An AC side (also referred to as output side) of power converter 106 may be connected to power grid 110. Controller 108 may be connected to power converter 106. Although, in system 100, energy generation source 102 is shown to be connected to power converter 106 via energy storage unit 104, it will be apparent to person with ordinary skill in the art that energy generation source 102 may directly be connected to power converter 106 thereby bypassing energy storage unit 104.

Energy generation source 102 may be configured to generate energy locally. For example, energy generation source 102 may be a distributed energy resource or a renewable energy resource, such as a solar panel, a diesel generator, a wind mill, etc. The energy generated by energy generation source 102 may be provided to energy storage unit 104. Energy storage unit 104 may store the energy generated by energy generation source 102. For example, energy storage unit 104 may be a battery configured to store the generated energy. Energy storage unit 104 may be configured to provide energy at a constant rate to power converter 106. For example, irrespective of rate of generation of the energy by energy generation source 102, energy storage unit 104 may provide the stored energy to converter 106 at a predetermined rate. Moreover, energy storage unit 104 may be configured to absorb power from power grid through power converter 106. Energy storage unit 104 may be configured to provide and absorb both real and reactive power from power grid 110.

Power converter 106 may be configured to convert DC energy stored in energy storage unit 104 and generated by power generation source 102 into AC energy. For example, power converter 106 may be a sine wave grid-tied inverter designed to inject electricity into power grid 110. Power converter 106 may be configured to synchronize with the frequency of the power grid 110, and inject less than a predetermined level of harmonic distortion. For example, power converter 106 may be a single stage flyback converter.

Operations of power converter 106 may be controlled by controller 108. For example, controller 108 may control an output of power converter 106. Controller 108 may control the output of power converter 106 by defining output characteristics of power converter 106. For example, controller may define a power factor, a harmonic distortion level, a voltage level, etc. for the output of power converter 106. Controller 108 may continuously monitor the output of power converter 106, and based on the output and the defined output characteristics, may alter operations of power converter 106. For example, controller 108 may alter a switching sequence of switches of power converter 106. Controller 108 may be accessible to and managed by a user. For example, a user may provide the output characteristics to power controller 108.

Power grid 110 may be an electricity distribution system grid. For example, power grid 110 may be a secondary voltage grid, supplying power to residential areas. A voltage and a frequency of the power grid 110 may be predefined and fixed. Power grid 110 may include line equipment to keep the voltage and the frequency within the predefined limits. Other electrical characteristics of power grid 110, such as power factor limit, total harmonic distortion limit, may also be predefined. Controller 108 may be configured to receive a continuous reading of the electrical characteristics of power grid 110.

Figure 2:
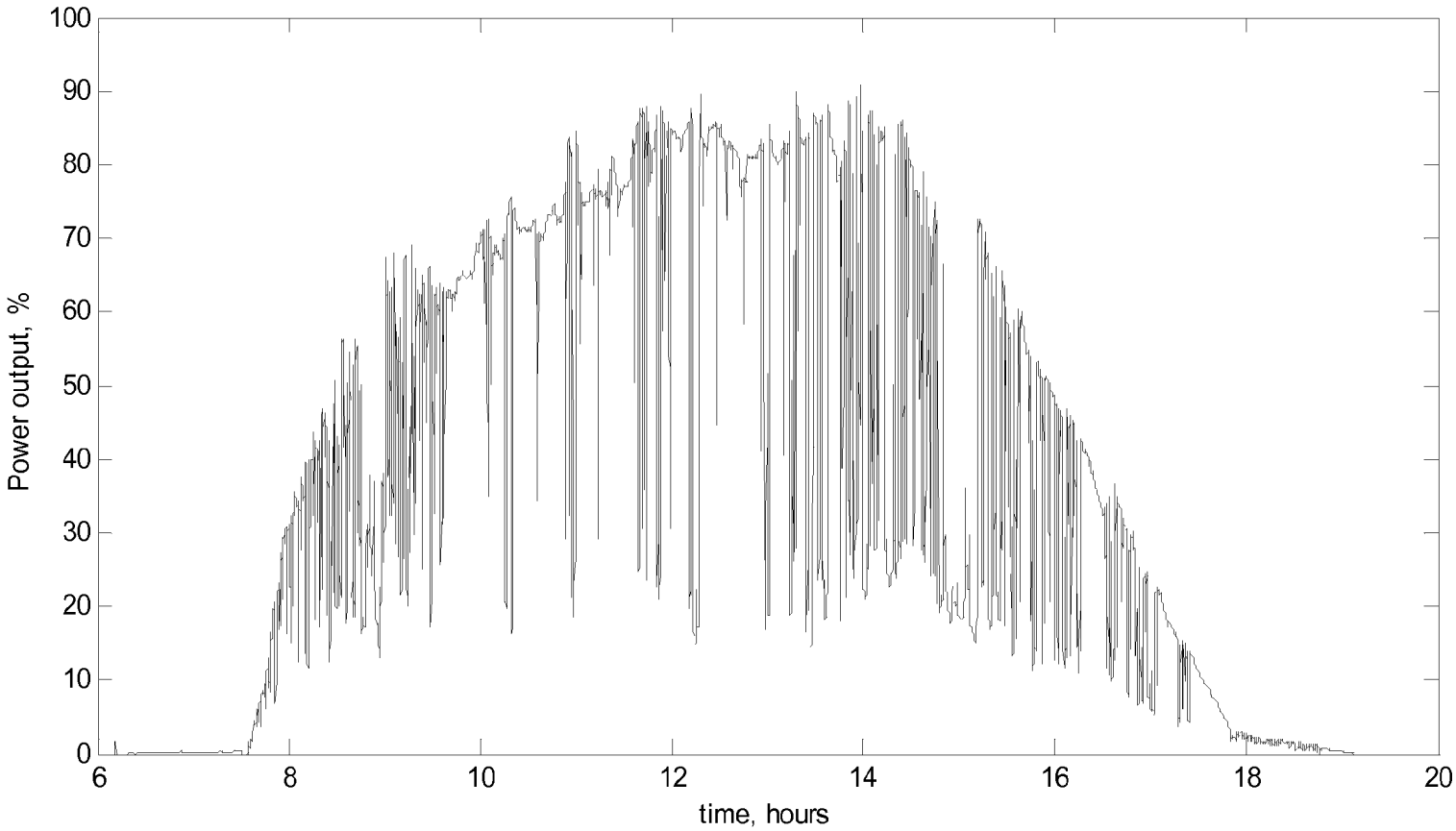
FIG. 2 is graph illustrating fluctuation in energy generated by an energy generation source.

An amount of energy generated by energy generation source 102 may depend on variable parameters. For example, the amount of energy generated by energy generation source 102 may depend on weather conditions. Because of dependence on the variable parameters, such as weather conditions, the amount of energy generated by energy generation source 102 may fluctuate with the fluctuation in the weather conditions. The fluctuation in the energy generation may be referred to as intermittency. Such fluctuations may be associated with renewable energy generation sources, especially wind and photovoltaics (PV). For example, FIG. 2 shows an output power measurement of a 4.8 kW PV installation on a typical partly-cloudy day. The energy generation from such renewable energy sources may exhibit sharp swings of 70-80% of total rated power tens of times per day.

Accelerated integration of intermittent energy generation sources into power grid 110 may pose operational challenges to grid operators. For example, a power quality of power grid 110 may be affected due to high penetration of intermittent energy generation sources. As another example, the fluctuation in energy generation may result in a voltage fluctuation in power grid 110.

While total PV capacity installed remains a tiny fraction of total power generation on the bulk system in power grid 110, there may be many localized pockets of the high PV penetration on a distribution network. For example, localized high penetration of PV on power grid 110 may result in localized voltage fluctuations and reduce the power quality for customers served by power grid 110. Increased voltage fluctuation may result in customer visual irritation. In addition, the voltage fluctuation in power grid 110 may lead to accelerated ageing and possible damage of customer equipment that may be coupled by significant financial losses due to loss in productivity. Moreover, the voltage fluctuation induced by intermittency may lead traditional line-equipment such as voltage regulators and capacitor banks to operate more frequently than designed for. Such line-equipment may typically be designed to operate 2-3 times a day, while they may be triggered twenty to thirty times due to intermittency, leading to severe wear and tear.

Figure 3:
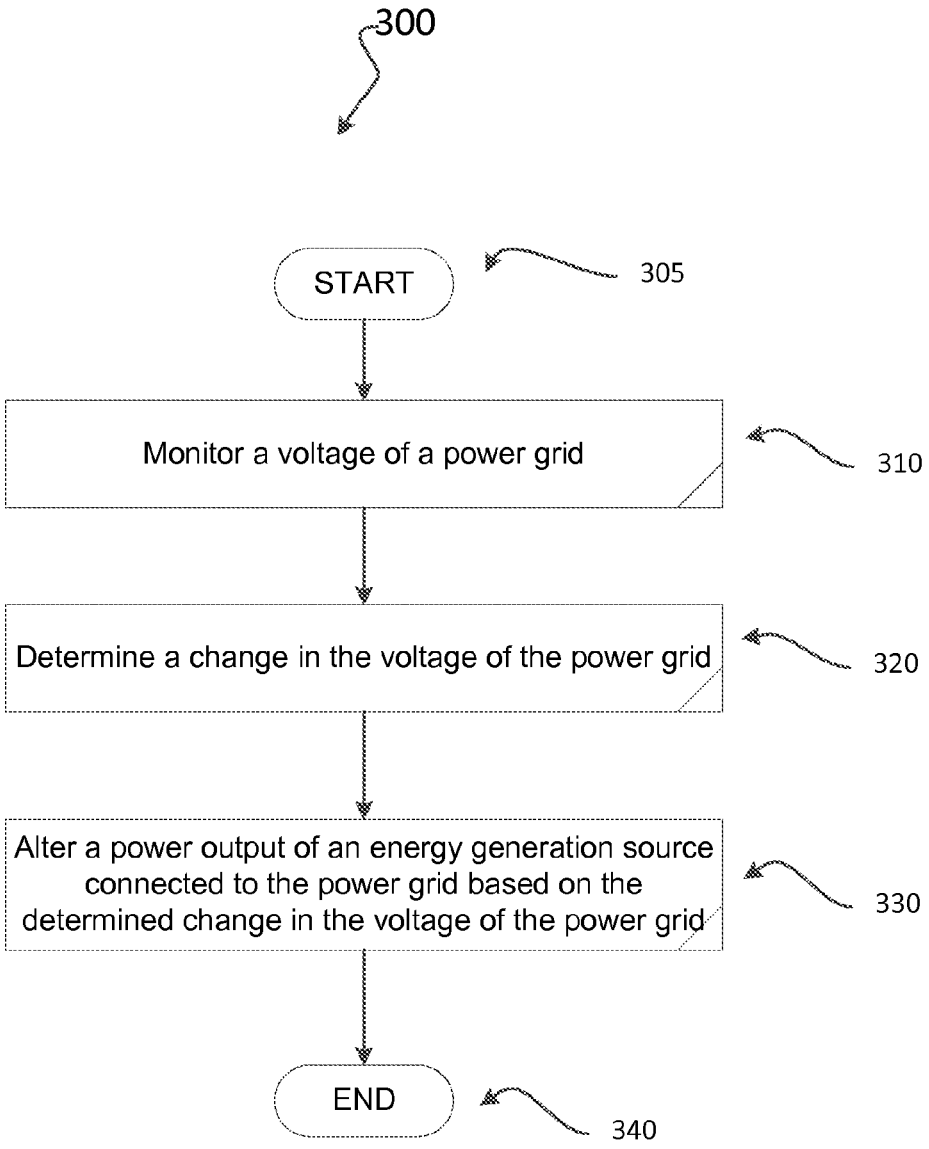
FIG. 3 is a flow diagram of a method for mitigating voltage fluctuation in a power grid.

In response to challenges related to intermittency, grid operators may implement guidelines and policies that effectively limit PV deployments. For example, grid operators may require customers to pay for costly upgrades such as re-conductoring of power grid 110 or upgrading of the line-equipment. These measures may have often stopped PV projects by hurting economic feasibility of such installations. In one embodiment, FIG. 3 shows a flow diagram of a method 300 for mitigating intermittent generation impact on power grid 110 from energy generation source 102. Method 300 may be implemented using controller 108 and power convertor 106. Ways to implement method 300 will be described in more detail below.

As shown in FIG. 3, method 300 may begin at starting block 305 and proceed to stage 310 where a voltage of power grid 110 may be monitored. For example, the voltage of power grid 110 may be monitored by controller 108. The voltage may be monitored by sensing the voltage of power grid 110 and comparing with a predetermined voltage level of power grid 110. The voltage may be monitored using a sensor located on a point of contact of energy generation source 102 and power grid 110.

From stage 310, where controller 108 monitors voltage on power grid 110, method 300 may advance to stage 320 a change in the voltage of power grid 110 may be determined. For example, controller 108 may determine whether the voltage on power grid 110 has decreased or increased from a previous value. The change in the voltage of power grid 110 may be determined by comparing the sensed voltage with the defined voltage level of power grid 110. Such change in the voltage on power grid 110 may be referred to as a voltage fluctuation.

After controller 108 has determined the change in voltage on power grid 110 at stage 320, method 300 may advance to stage 330 where a power output of energy generation source 102 connected to power grid 110 may be altered. For example, when the determined change in voltage at power grid 110 is more than a predetermined threshold level, controller 108 may alter the output of energy generation source 102 to compensate for change in the voltage. The output of energy generation source 102 may be changed by controller 108 by changing operating parameters of power converter 106. For example, controller 108 may alter the operating parameters of power converter 106 to absorb or inject reactive power in power grid 110 to compensate for the change in the voltage. As another example, controller 108 may alter a power factor of the energy being injected into power grid 110 by power converter 106. Once, controller 108 has altered the power output of energy generation source 102 connected to power grid 110 at stage 330, method 300 may end at stage 550.

Figure 4:
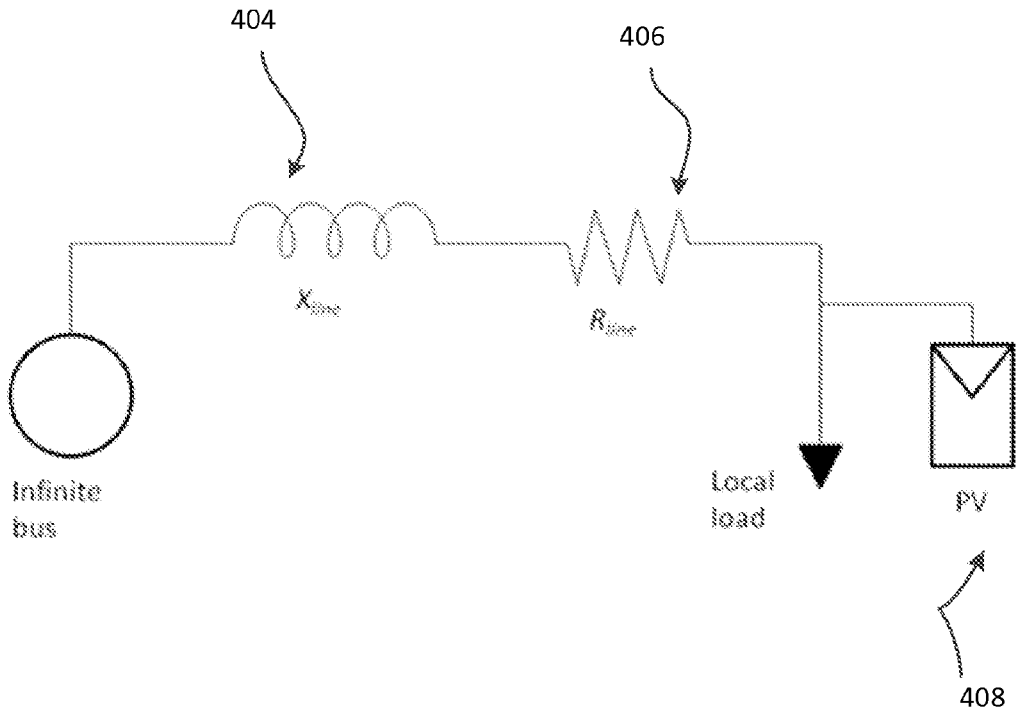
FIG. 4 is a schematic representation of an impedance of a power grid.

As described above, the voltage fluctuation in power grid 110 may be caused by the intermittent energy generation by energy generation source 102 connected to power grid 110. For example, the voltage fluctuation may be caused by impedance associated with wire of power grid 110. The wire of power grid 110 may have resistive and reactive (inductive) components. A schematic representation of power grid 110 is shown in FIG. 4. As shown in FIG. 4, the resistive component of power grid 110 may be represented by $R_{line}$ 406 and the reactive component of power grid 110 may be represented by $X_{line}$ 404. The impedance associated with the wire may lead to voltage change across the wire. For example, the impedance may lead to a drop in voltage along power grid 110. The voltage drop across the impedance of power grid 110 may be represented by equation (1) below.

$$\Delta V \approx \frac{\Delta P}{V} \cdot R_{line} + \frac{\Delta Q}{V} \cdot X_{line} \tag{1}$$

As shown in the equation (1), real power may produce voltage rise/drop across the resistive component of the impedance. Similarly, injection or absorption of reactive power may introduce voltage rise/drop across the reactive (inductive) part of that impedance. Rapid fluctuation of a net power flow due to the intermittent energy generation source 102 may be a primary mechanism for the voltage fluctuation associated with PV system 408.

In one embodiment, by managing the reactive power output of energy generation source 102, the voltage fluctuation on power grid 110 may be mitigated. For example, altering an amount of reactive power injected by energy generation source 102 may result in mitigation of the voltage fluctuations on power grid 110. Injection of the reactive power may cause voltage fluctuation in the opposite direction to those resulting from the intermittency, and thus may reduce the voltage fluctuation on power grid 110. For example, the voltage fluctuation in power grid 110 may be eliminated if Equation (2) provided below holds true for various sections of power grid 110.

$$\frac{\Delta Q}{\Delta P} = -\frac{R_{line}}{X_{line}} \tag{2}$$

In one embodiment, an amount of reactive power to be injected to power grid 110 to mitigate the voltage fluctuation may be determined based on configuration parameters associated with power grid 110. For example, the injection of reactive power may affect the voltage at various parts of power grid 110 differently based on the impedance characteristics of power grid 110. Power losses across power grid 110 may increase or decrease depending on whether a magnitude and direction of the injected reactive power helps reduce a net reactive power demand of nearby loads. Hence, the reactive power component of various systems on power grid 110 may need to be properly coordinated to optimize a voltage profile while minimizing the power losses.

Figure 5:
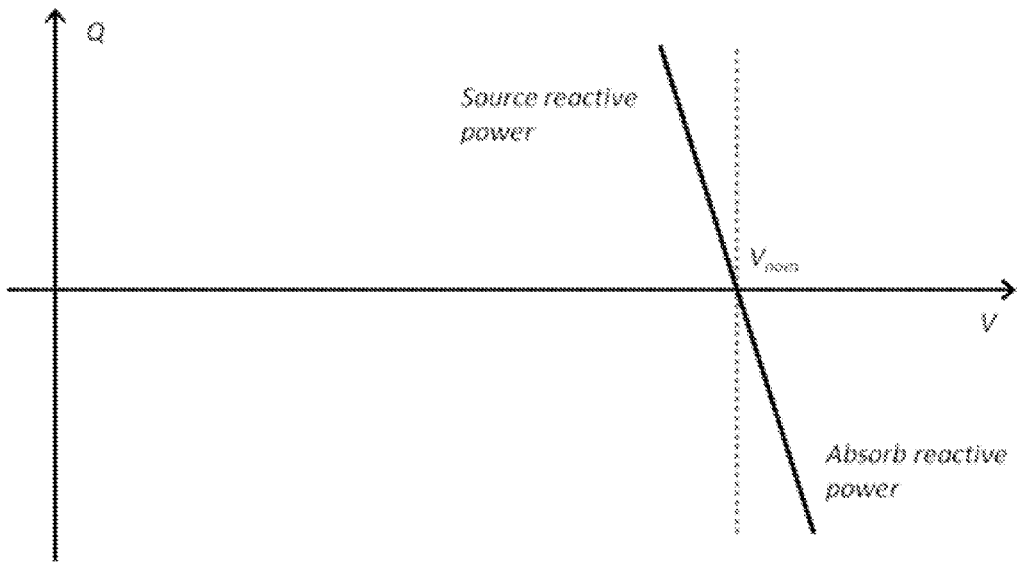
FIG. 5. is a volt/var droop characteristics curve.

In one embodiment, methods for determining an appropriate amount of reactive power to be injected in power grid 110 in order to mitigate the voltage fluctuation may be provided. One example method may include determining the amount of the reactive power based on a ratio between the voltage and VAr of power grid 110. The method based on Volt-VAr ratio may include scheduling a reactive power output of power converter 106 as a function of voltage at a designated point of power grid 110. For example, the reactive power output of power converter 106 may be controlled based on the voltage of power grid 110 at a point of interconnection of power converter 106 and power grid 110. A linear function with negative slope, as shown in FIG. 5 may be used. The point of intersection with the voltage axis may represent a nominal voltage at which no reactive power may be injected or absorbed. The Volt-VAr function or the linear function as shown in FIG. 5, may be modified to have different slope, nominal voltage, piece-wise linear segments, a dead-band region around the nominal voltage, and/or defined by a function or set of functions for discrete voltage ranges.

Figure 6A:
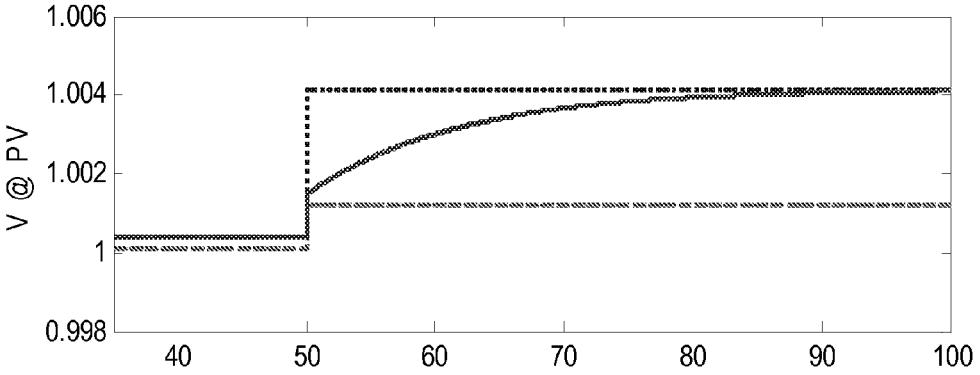
FIG. 6*a*. is a voltage vs time plot.
Figure 6B:
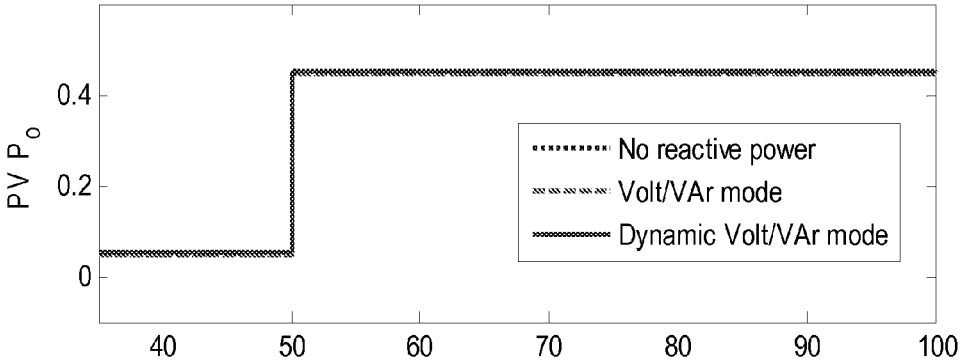
FIG. 6*b*. is a real power vs time plot.
Figure 6C:
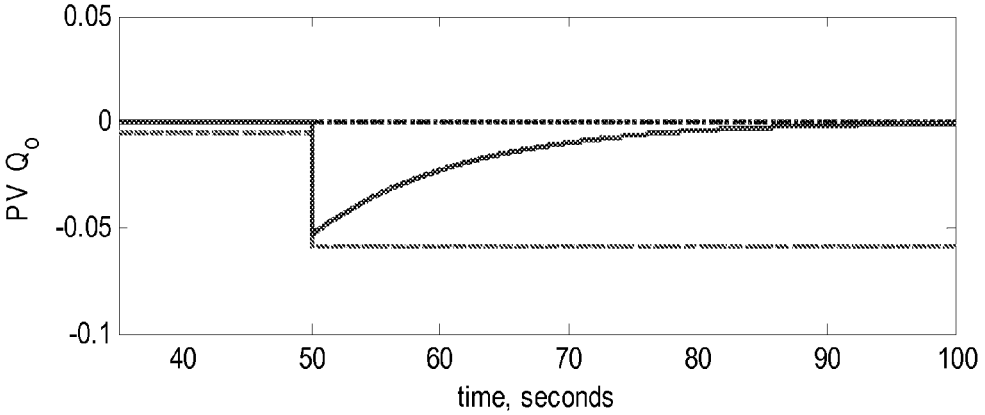
FIG. 6*c*. is a reactive power vs time plot.

Volt-Var based method may be employed to address fast voltage fluctuation by following a droop curve. After transient conditions settle, the reactive power level of power converter 106 may slowly be ramped back to its initial value around zero as shown in FIGS. 6*a*, 6*b* and 6*c*. This may implemented as a Volt-VAr droop where a nominal voltage set-point is a slow-moving average of the voltage of power grid 110. Different characteristics may be achieved by modifying the relationship between the nominal voltage to the voltage of power grid 110. For example, a non-zero steady state reactive power level may be determined based on some of the other methods.

Figure 7:
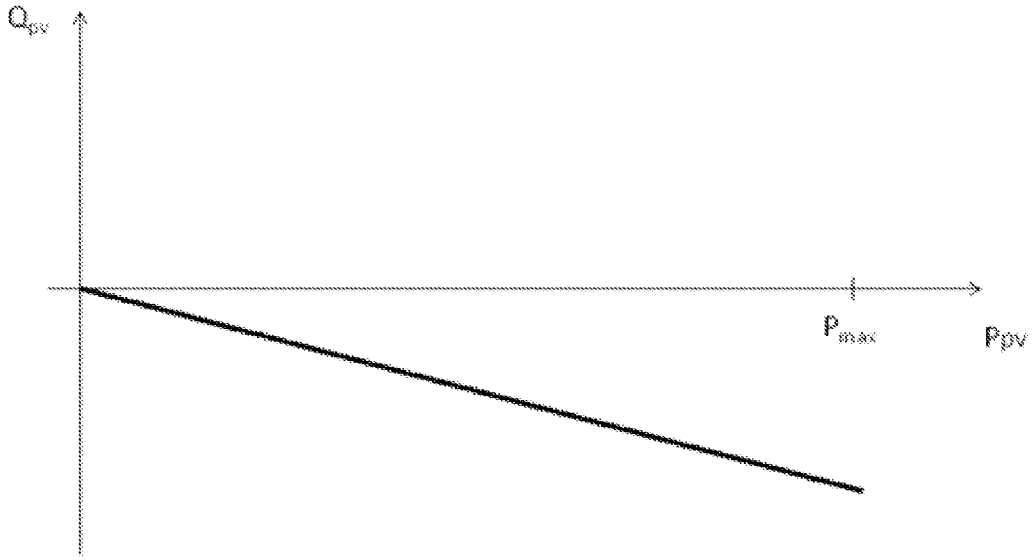
FIG. 7. is a plot of constant power factor characteristics.

In another method, the amount of reactive power to be injected in power grid 110 to mitigate the voltage fluctuation may be determined based on a constant power factor. For example, power converter 106 may be configured to absorb reactive power at a level proportional to real power it delivers to power grid 110 as depicted in FIG. 7. Setting power converter 106 to a constant absorbing power factor is may be effective method with some limitations. An advantage of the method based on the power factor may be an ability to address intermittency caused by energy generation source 102. For example, by addressing the intermittency caused by energy generation source 102 may make the intermittency less visible on power grid 110. Another advantage may include reduction in a number of interactions with the line equipment. For example, the constant power factor based may not require a measure of the voltage of power grid 110, and may ensure compatibility with prevalent standards such as IEEE1547.

Power converter 106 may be programmed to auto-configure its power factor setting to reduce the voltage fluctuation on power grid 110. For example, controller 108 may correlate real-time measurements of real power, reactive power, voltage, and/or a combination of these quantities to determine appropriate power factor settings. The power factor determination by controller 108 may reduce or eliminate the modeling required for configuration of energy generation source 102. In addition, the determination of power factor settings by controller 108 may enable the voltage fluctuation mitigation to continue to be effective even after power grid 110 upgrades and/or real-time reconfiguration of topology related to power grid 110.

Auto-configuration of the power factor setting may be achieved in different methods. For example, a "perturb and observe" (P&O) method may be used to configure the power factor settings. In P&O method, the power factor may be changed, i.e. incremented or decremented, and an effect of change in the power factor in the voltage fluctuation may be monitored. If the voltage fluctuation decreased, the power factor may further be changed in the same direction. If voltage fluctuation increased, the power factor may be changed in an opposite direction of the initial change. In another example, the power factor setting may be determined based on a mathematical correlation of the real power and the reactive power fluctuations to the voltage fluctuation. The power factor settings may be automatically adjusted by controller 106, or by other systems such as a supervisory controller, or a distribution management system.

Figure 8:
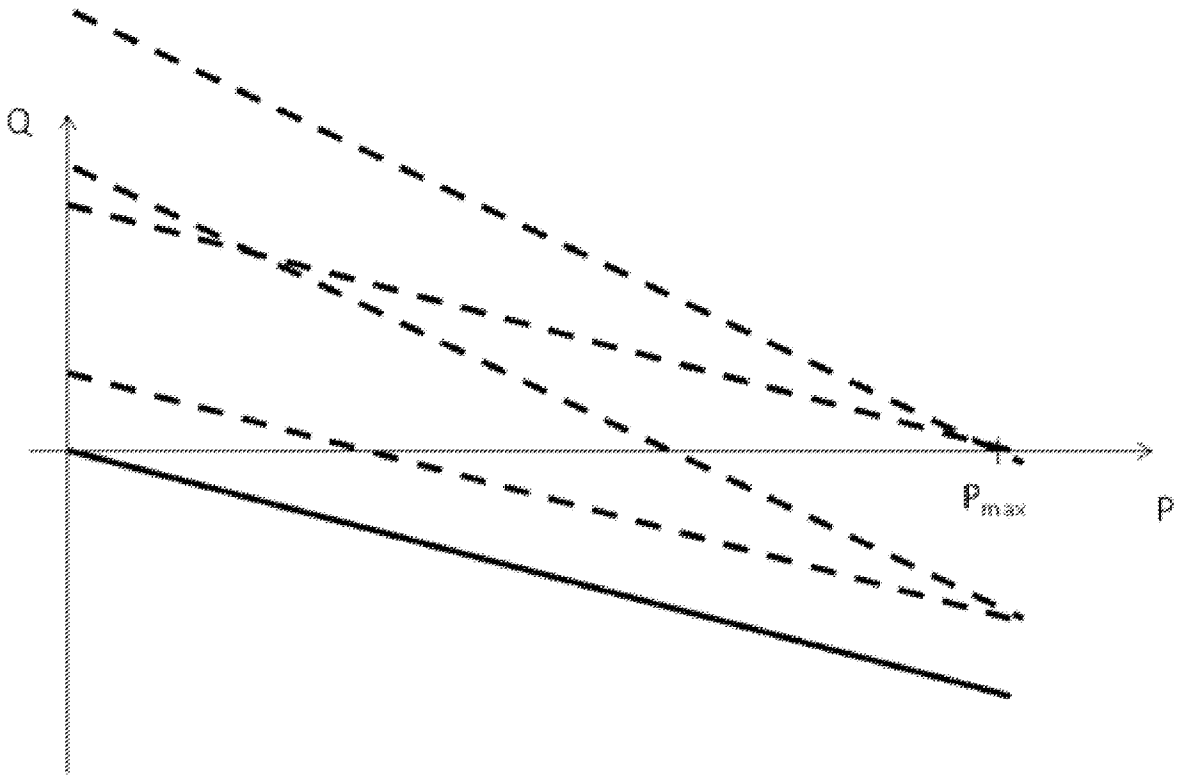
FIG. 8. shows characteristics curves under biased P-Q approach.

In yet another method, the amount of reactive power to be injected in power grid 110 to mitigate the voltage fluctuation may be determined based on a biased P-Q approach. The biased P-Q approach may be considered as an evolution of the constant power factor approach. Under the biased P-Q approach, the real power vs. the reactive power characteristic of power grid 110 may be biased by adding (or subtracting) a reactive power component, as shown in FIG. 8. The reactive power bias may be used to reduce or eliminate the need to absorb reactive power from the line. This would reduce the net reactive power loading and associated power losses in a typical circuit with a net lagging power factor. Moreover, the biased P-Q based method may reduce the apparent power rating requirement of the PV inverter.

Adaptive auto-configuration techniques may also be utilized to configure the biased P-Q algorithm parameters. Auto-configuration may be used for the reactive power bias value, the slope of the curve, or a combination of both. For example, the reactive power output of energy generation source 102 may be determined based on a relation of real power (P) and reactive power (Q), where a reactive power bias may be used and result in non-zero reactive power level when real power is at zero. Parameters of the biased P-Q algorithm may include, such as but not limited to, a reactive power bias, a slop of the P-Q curve, or a combination of both.

In one embodiment, the amount of the reactive power to be injected may be determined based on a multitude of variables such as the real power, the voltage, the reactive power bias, ambient temperature, and various combinations of such variables. The amount of the reactive power may be represented by a linear combination of such variables, such as equation (3) provided below:

$$Q=Q_0+f_1(P_o)+f_2(V)+f_3(T)+\ldots \quad (3)$$

In one embodiment a priority may be defined for the real power and the reactive power. The priority for the real or reactive power may be defined by the user or the grid operator. A total apparent power output (combination of real and reactive power) of energy generation source 102 may be limited due to device ratings. Under such conditions, a priority of delivery of real vs. reactive power may be defined by the user or the grid operator. The priority may be granted to the real power, the reactive power, or both. The priority may be weighted according to certain coefficients, and be dependent on other system variables such as the voltage, operating mode, time schedules, state variables, or a combination of such variables.

Moreover, a ramp rate of the amount of reactive power to be injected in power grid 110 may be controlled. The ramp rate of the real power and the reactive power may be controlled. For example, when power converter 106 first connects to power grid 110 in the morning, immediate injection of high levels of the reactive power may cause significant voltage fluctuation. Applying ramp rate control on the injection of reactive power may eliminate such voltage fluctuations.

In addition, the reactive power may be injected in power grid 110 based on a predetermined schedule. For example, a time schedule for the injection of reactive power may be created. The time schedule may be created based on at least one of: absolute time, time relative to power grid 110 events, a time of day, a day of the week, and an operating season. Moreover, configuration parameters involved in the determination of the amount of reactive power to be injected may change smoothly or abruptly by applying time-based averaging or filtering. In addition, the configuration parameters may be randomized. The randomization of the configuration parameters may be useful in softening a response of large populations of power converter 106 in response to various events on power grid 110.

In addition to and along with the injection of reactive power, the voltage fluctuations in power grid 110 may be controlled by injecting harmonic currents. Injection of harmonic currents may be utilized to correct/improve distortion in the voltage waveform. The order, level, and phase of the harmonics injected may be determined in many different ways. For example, order, level, and phase of the harmonics injected may be determined based on direct response to harmonics in the voltage waveform, scheduling based on voltage levels, power levels, time-scheduling, or a combination of techniques. Adaptive techniques may also be used to auto-configure the parameters governing harmonic injection.

The methods and systems described above may respond to rapid voltage fluctuations by injecting or absorbing reactive power following configurable characteristics. For example, the amount of reactive power to be injected may be adjusted to slowly move to a different level in steady state. Steady-state reactive power level may be zero, or may be determined by a relation to a variety of different configuration parameters, state variables, or measured values.

Embodiments of the present disclosure, for example, are described above with reference to block diagrams and/or operational illustrations of methods, and systems, according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved. Moreover, the methods described above may be stored on a memory device in form of instructions. For example, the instructions may be stored on the memory device associated with controller 108. The instructions stored on the memory device may be processed by a processor. For example, the instructions may be processed by a processor associated with controller 108.

While certain embodiments of the disclosure have been described, other embodiments may exist. While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

What is claimed is:

1. A method comprising:

monitoring a voltage of a power grid;

determining a change in the voltage of the power grid; and altering a power output of an energy generation source connected to the power grid based on the determined change in the voltage, wherein altering the generation of the reactive power comprises;

determining an amount of reactive power required to compensate the change in the voltage, wherein determining the amount of reactive power required to compensate the change in the voltage comprises determining the amount of reactive power to compensate the change in the voltage wherein the amount of reactive power is determined based on a droop curve, and injecting the determined amount of the reactive power from the power grid by the energy generation source.

2. The method of claim 1, wherein monitoring the voltage comprises monitoring the voltage at a point of contact of the energy generation source and the power grid.

3. The method of claim 1, wherein determining the change in voltage comprises determining a voltage fluctuation on the power grid.

4. The method of claim 1, wherein altering the power output of the energy generation source comprises altering generation of a reactive power of the energy generation source.

5. A system comprising:

a processor, and a memory having instructions which when executed by the processor performs a method comprising:

monitoring a voltage of a power grid;

determining a change in the voltage of the power grid; and altering a power output of an energy generation source connected to the power grid based on the determined change in the voltage, wherein altering the generation of the reactive power comprises;

determining an amount of reactive power required to compensate the change in the voltage, wherein determining the amount of reactive power required to compensate the change in the voltage comprises determining the amount of reactive power to compensate the change in the voltage wherein the amount of reactive power is determined based on a correlation between the change in the voltage, the reactive power and an active power, and injecting the determined amount of the reactive power from the power grid by the energy generation source.

6. The system of claim 5, wherein monitoring the voltage comprises monitoring the voltage at a point of contact of the energy generation source and the power grid.

7. The system of claim 5, wherein determining the change in voltage comprises determining a voltage fluctuation on the power grid.

8. The system of claim 5, wherein altering the power output of the energy generation source comprises altering generation of a reactive power of the energy generation source.

9. A system comprising:

an energy generation source connected to a power grid via a power converter; and a controller configured to control the power converter, the power converter configured to, monitor a voltage of a power grid, determine a change in the voltage of the power grid, and alter a power output of an energy generation source connected to the power grid based on the determined change in the voltage, wherein the power converter being configured to alter the generation of the reactive power comprises the power converter being configured to;

determine an amount of reactive power required to compensate the change in the voltage, wherein the power converter being configured to determine the amount of reactive power required to compensate the change in the voltage comprises the power converter being configured to determine the amount of reactive power to compensate the change in the voltage wherein the amount of reactive power is determined based on a predetermined power factor, and inject the determined amount of the reactive power from the power grid by the energy generation source.

10. The system of claim 9, wherein the system further comprises an energy storage unit connected to the energy generation source and the power converter.

11. The system of claim 9, wherein the power converter being configured to monitor the voltage comprises the power converter being configured to monitor the voltage at a point of contact of the energy generation source and the power grid.

12. The system of claim 9, wherein the power converter being configured to determine the change in voltage comprises the power converter being configured to determine a voltage fluctuation on the power grid.

13. The system of claim 9, wherein the power converter being configured to alter the power output of the energy generation source comprises the power converter being configured to alter generation of a reactive power of the energy generation source.

* * * * *